United States Patent [19]

Berns

[11] Patent Number: 4,458,303

[45] Date of Patent: Jul. 3, 1984

[54] LIGHT BEAM CONCENTRATING, INTENSIFYING AND FILTERING DEVICE

[76] Inventor: Michael S. Berns, 18 E. Old Willow Rd., Suite 220N, Prospect Heights, Ill. 60070

[21] Appl. No.: 381,576

[22] Filed: May 24, 1982

[51] Int. Cl.[3] ..... F21V 17/02

[52] U.S. Cl. ..... 362/321; 362/64; 362/281; 362/293; 362/298; 362/300; 362/346; 362/360; 362/367; 362/375

[58] Field of Search ..... 362/281, 293, 298, 300, 362/321, 346, 360, 367, 375, 64

[56] References Cited

U.S. PATENT DOCUMENTS

| | | | |
|---|---|---|---|
| 3,016,454 | 1/1962 | Simms | 362/321 |
| 4,208,100 | 6/1980 | Bischl | 362/321 |

*Primary Examiner*—Stephen J. Lechert, Jr.

*Attorney, Agent, or Firm*—Larson and Taylor

[57] ABSTRACT

A light beam concentrating, intensifying and filtering device for use in combination with a parallel ray light source is comprised of a frame having a plurality of shutter leaves capable of opening and closing an aperature when actuated. Each shutter leaf is comprised of a colourless or coloured transparent portion and a portion that is coated on its inner surface with a reflective material.

14 Claims, 10 Drawing Figures

LIGHT BEAM CONCENTRATING, INTENSIFYING AND FILTERING DEVICE

This invention relates to a means for varying the cross sectional area of a light beam while simultaneously varying the degree to which the light beam is filtered. The invention has particular application to vehicular headlamps, spot lights, search lamps, hand-held lanterns, and flashlights.

At the present time, it is not possible to obtain satisfactorily beamed light of desired cross sectional area and filtering to suit varying conditions for which the beamed light is desired without having to resort to either multiple lamp assemblies or cumbersome attachments to existing lamps. In particular, when there are conditions of reduced or poor visibility due to fog, smog, rain, snow, or smoke, etc., conventional beamed lights do not improve visibility due to the reflections and refraction of the beamed light from the fog, smog, rain, snow, or smoke, etc.. When these unusual atmospheric conditions are present, it would be more desirable to have a beamed light which is amber in color and with a beam of small cross sectional areas. Anyone who has driven at night in a snow storm or in fog appreciates that conventional "low" beam lights being less divergent than the high beam lights. Also, anyone who has "fog" lamps on their automobile appreciates that the amber colored light emitted therefrom is much more effective than the normal white light beam from the automobile headlights.

The present invention has the advantages of an amber fog lamp, a high intensity driving lamp, and the general utility of a conventional lamp, and additionally permits an infinite degree of adjustment between these three extremes in order to match the cross sectional area, divergence, and filtering of the light beam to the particular conditions under which it is to be used. Although use as an automobile headlamp is the most obvious application of the present invention, it could equally be used in a hand-held lantern for use, for example, by firefighters who, at times, require a lantern casting a cross sectionally broad white light or a cross sectionally small intense white light, yet under conditions of heavy smoke would require a lantern casting smoke piercing cross sectionally narrow beam of amber colored light. The present invention would avoid the need to have two or more separate lanterns.

The present invention can also be adapted onto the conventional headlamps of an automobile or other vehicle thus obviating the need for additional fog lamps or driving lamps on the vehicle. In addition, by way of a variety of techniques, such as cables extending from the headlights into the car, or by vacuum switch means, or other modes, the present invention can be adjusted from inside the automobile in order that the conventional headlamps would emit a cross sectionally broad or narrower white beam of light or a cross sectionally narrower amber beam of light or any of an infinite number of positions therebetween.

One conventional technique as found in U.S. Pat. No. 583,943 issued on Sept. 20, 1959 to Fischer discloses a device which pumps a yellow or amber colored fluid from a reservoir into a container placed on an automobile's headlights to produce an amber colored light when the car's headlights are turned on. This device has several major drawbacks, including the cumbersome necessities of having to use various hoses, reservoirs and containers, the possibility of poor or nonoperation caused by a loss of fluid through evaporation or a leak in the device, the loss of the device's airtightness, or the freezing of the fluid in cold weather and resultant damage to the device.

It is an object of the present invention to provide a lamp capable of producing a beam of light which may be varied from a cross sectionally wide white beam to a cross sectionally narrower white or amber colored beam.

It is another object of the present invention to provide a lamp in which the beams may be varied, as will be described subsequently, through the use of a simple mechanism, without the need of installing and removing additional attachments.

The foregoing and other objects of the invention are obtained by providing a parallel ray light source, preferably of the parabolic reflector type, in association with a leaf shutter, not unlike that used in a conventional camera lens. The leaf shutter may be of a planar or a curvilinear configuration, and is located in axial alignment with the reflecting element of the lamp, such that the leaf shutter will intercept a portion of the light rays eminating from the lamp. The lamp may be conventional, or a high intensity quartz halogen lamp, or any other type of light source.

A portion of the surface of each of the shutter leaves is comprised of opaque material, sometimes also being reflective material, and another portion of each of the leaves is comprised of a transparent material. The transparent material may be amber or any other desired color. The portion of each leaf which is reflective or opaque and which is transparent may be varied to achieve different results, as will be detailed subsequently.

In one embodiment of the present invention, the leaves are made completely of a material which is reflective on the inner surface (the surface towards the interior of the lamp) and is coated with a transparent colored material. In this embodiment, the filtering of the light beam is achieved by its passage through the coating as it strikes the reflective surface of the leaves, and then rereflects from the parabolic or other reflector leaves, and then rereflects from the parabolic or other reflector and exits the lamp.

The lamp operates as a normal parabolic reflector lamp when the shutter leaves are in the wide open position, that is to say, the light beam is relatively large in cross sectional area and unfiltered. When the shutter leaves are employed to close the orifice through which the light beam exits, the light beam exiting the lamp is filtered and is narrower in cross section. A feature of this embodiment is that when the shutter leaves are employed to constrict the orifice, the light beam is not uniformly filtered, that is, it tends to be less filtered close to the axis of the light beam and more filtered with increasing radial distance from the axis of the beam. This effect would be desirable under many applications such as under conditions of fog or light rain.

A better understanding of the present invention may be had by reference to the accompanying drawings which describe preferred embodiments of the present invention by way of example.

Figure 1:
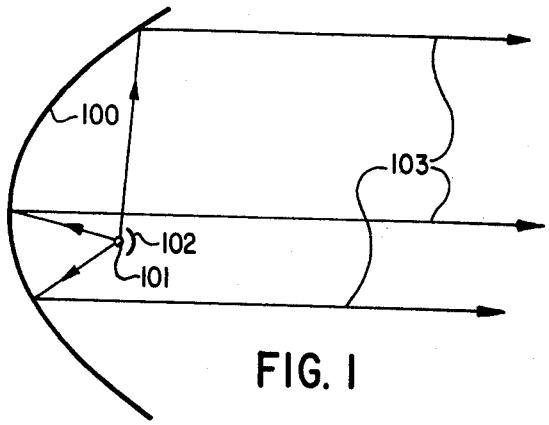
FIG. 1 is a schematic view of a conventional parabolic reflector lamp illustrating the path of light rays eminating from the light source.

FIG. 1 illustrates the principle of operation of a conventional parabolic reflector lamp. Light rays, represented by lines 103, eminate from a light source 101, located at the focus of the parabolic reflector. Light rays eminating from this point eminate and intersect the parabolic reflecting surface 100 at various points and are reflected so that all rays eminate in a substantially parallel fashion. A small cap reflector 102 may be provided to prevent direct radiation of light rays away from the lamp. As can be seen in FIG. 1, although the light beam eminating is a parallel light beam, it is large in cross sectional area.

Figure 2:
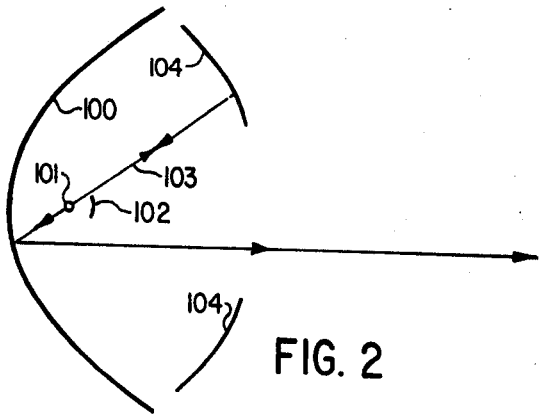
FIG. 2 is a schematic view of a parabolic reflector lamp of the present invention illustrating the effect of a curvilinear leaf shutter reflecting element.

FIG. 2 shows reflector 100 of FIG. 1, over which a shutter having a housing (not illustrated) and leaves with inner reflecting surfaces 104 has been placed. These inner reflecting surfaces 104 will intercept light rays, such as light ray 103, and reflect same back through the focus and light source 101 to hit the inner reflecting surface of the parabola so that the light ray eventually emerges through the orifice parallel to other light rays exiting. In the present invention, inner reflecting surfaces 104 are shown to be curvilinear in configuration. It is understood that the shutter housing may be of other configurations. Cap reflector 102 is optional, and the device will work whether or not it is in place. There may optionally be provided a clear, a transparent amber or other coloured coating on the inside reflecting surface 104 of the shutter leaves. This will cause some of the light rays exiting the device to be white, while other light rays exiting the reflecting device will be either white, or another predetermined color since they have first been reflected from clear or colored areas of surfaces 104.

Figure 3:
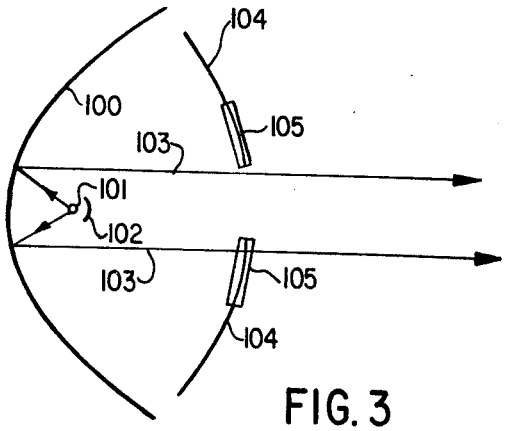
FIG. 3 is a schematic view of a parabolic reflector lamp of the present invention illustrating the effect of the transparent portions of the shutter leaf on light rays.

FIG. 3 illustrates one embodiment of the present invention having a shutter with leaves having portions 105, 104 which are respectively transparent and reflective. A typical light ray 103 eminating from source 101 can either be reflected through transparent leaf portion 105 or directly through the orifice. If the transparent portion 105 of leaf is amber colored, it can be seen that some light rays exiting the reflecting device will be amber colored and some will be white. Clearly, as the shutter leaves close the orifice through which the light rays exit, the exiting beam will be narrower in cross section and almost totally amber in color. If, however, the transparent portion 105 of the shutter leaf is partly reflective on its inner surfaces and partly clear, it can be seen that the light rays exiting the device will be wholly white. Clearly, as the shutter leaves close the orifice through which the light rays exit, the existing beam will be narrower in cross section and totally white in color.

Figure 4:
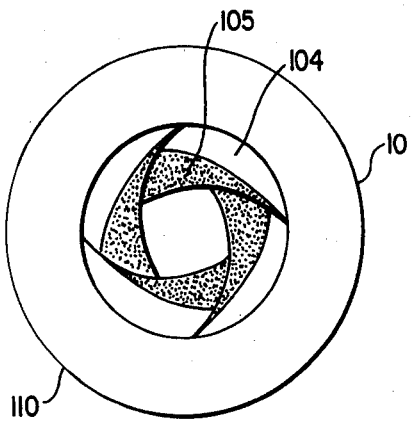
FIG. 4 is a leaf shutter assembly in the partially closed position in which the transparent and reflective portions of the leaves are shown.
Figure 5:
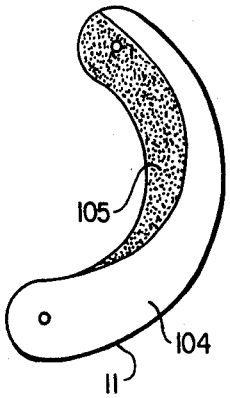
FIG. 5 is a view of one of the leaves of FIG. 4.

FIGS. 4 and 5 show a front view of the shutter having leaves which are transparent in portions. In FIG. 4, the shutter is shown in the partially closed portion, and leaf member portion 104 is reflective on its inner surfaces while leaf portion 105 is transparent. By making appropriate portions of each leaf transparent, the desired result of having the central portion of the device, when closed, a transparent colored or transparent clear material, will result. FIG. 5 shows a leaf having a transparent portion 105 and an inner reflective portion 104. Portion 105 can occupy up to 100% of the leaf in FIG. 5.

In addition, reflective portion 104 may be further subdivided into an inner first part situated adjacent clear portion 105 and capable of reflecting substantially all visible wavelengths of light, and an outer second, tinted, part situated adjacent the first portion and capable of reflecting only a narrow range of wavelengths of visible light. The division of the reflective portion 104 into two parts, the outer part of which is tinted renders the device capable of providing a nonintensified white light, an intensified white light, and an intensified tinted light.

Figure 6:
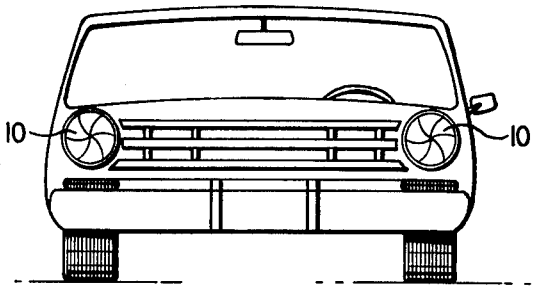
FIG. 6 is a picture of a motor vehicle showing the device employed on the headlamps.

FIG. 6 shows an automobile with the light beam filtering, concentrating and intensifying device mounted on the headlights at 10.

Figure 7:
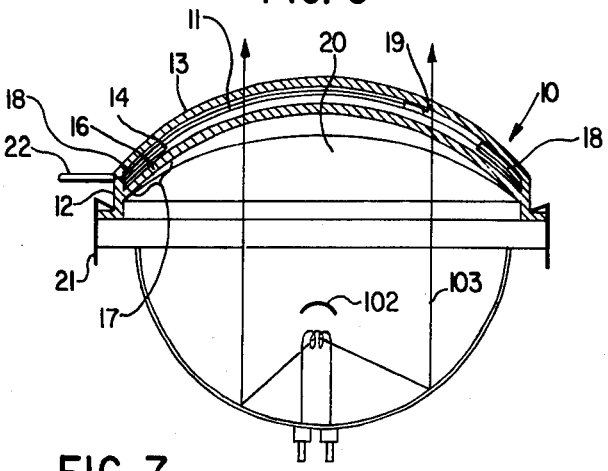
FIG. 7 is a cross sectional view showing the device employed on a parabolic reflecting lamp.

FIG. 7 shows a cross sectional view of the device mounted on an automobile headlamp. The device 10 generally includes a plurality of convex shutter leaf members 11 arranged in a generally parallel configuration in rotating retainer ring 14 and stationary iris diaphragm cover ring 18 and are, in turn, housed in iris diaphragm covers 13 and 16 which are connected at their perimeters by flanges 12 to a sealed beam automobile headlight unit 20 by circular or rectangular headlight unit retaining ring 21. Front and back iris diaphragm covers 13 and 16, respectively, are preferably made of one of the various plastics materials, but may also be made of glass or other suitable transparent material. Reflective or opaque surface 17 generally extends only around the perimeter of back cover 16 to a depth comparable to that of retainer ring 14 and cover ring 18. Leaf member 11 and rotating retainer ring 14 are operated within iris diaphram cover ring 18 by extruded portion 19. Extruded portion 19 is attached to remote flexible operating cable 22 for operation of device 10 from within the vehicle.

Figure 8:
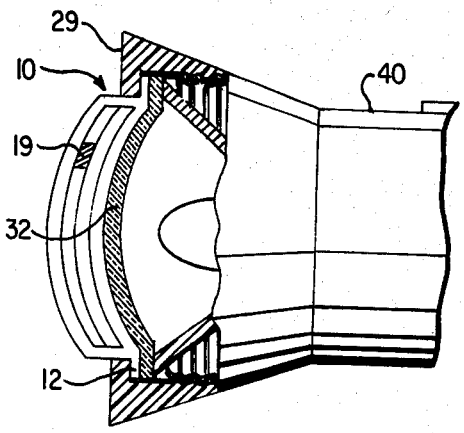
FIG. 8 is a cross sectional view of the device employed on a flashlight.
Figure 9:
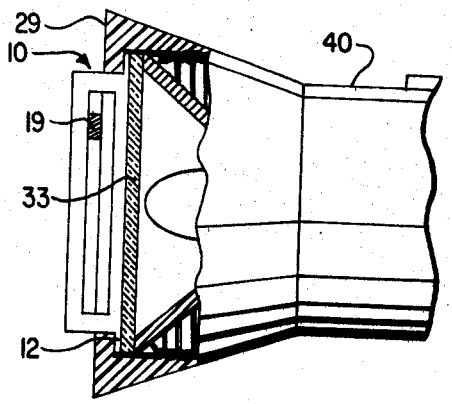
FIG. 9 is a cross sectional view of the device having a planar shutter and employed on a flashlight.
Figure 10:
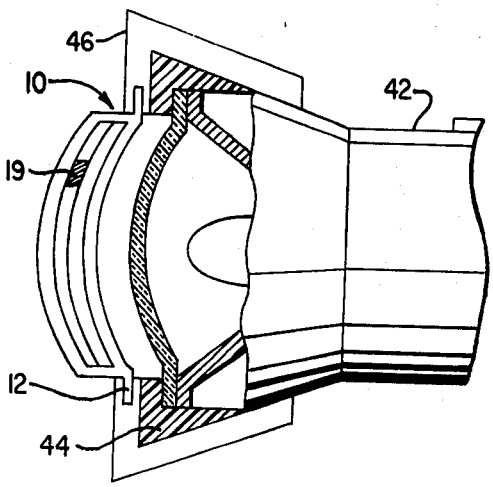
FIG. 10 shows the device of FIG. 8 employed on a flashlight with the device attached to the outside of the flashlight.

The attachment of the adjustable light beam filtering, concentrating and intensifying device to a portable flashlight or other light source is illustrated in FIGS. 8, 9, and 10. Conventional detachable lens housings 29 or the like permit the installation of flanges 12 of apparatus 10 onto conventional convex round lens 32 or conventional flat round lens 33. In the case of FIG. 8, the shutter leaves are disposed in a curvilinear manner. In FIG. 9, the shutter leaves are disposed in a planar manner.

FIG. 10 shows the device attached to a flashlight or other light source in another manner. This may be employed where lens housing 44 may not be detachable or wherein it is operated within iris diaphram cover ring 18 by extruded portion 19. Extruded portion 19 is attached to remote flexible operating cable 22 for operation of device 10 from within the vehicle.

The attachment of the adjustable light beam filtering, concentrating and intensifying device to a portable flashlight or other light source is illustrated in FIGS. 8, 9, and 10. Conventional detachable lens housings 29 or the like permit the installation of flanges 12 of apparatus 10 onto conventional convex round lens 32 or conventional flat round lens 33. In the case of FIG. 8, the shutter leaves are disposed in a curvilinear manner. In FIG. 9, the shutter leaves are disposed in a planar manner.

FIG. 10 shows the device attached to a flashlight or other light source in another manner. This may be employed where lens housing 44 may not be detachable or wherein it is desirable to be able to securely yet quickly attach or remove apparatus 10 by means of flexible sleeves 46 which fit securely over generally portable light lens housing 44 and flanges 12 on apparatus 10.

It should be noted that when the device 10 is attached to a flashlight, or other light source, there is no need for remote flexible operating cable 22, as extruded portion, 19 may be manipulated by hand to operate the device.

It should be noted that alternative attachments of the embodiments of the apparatus to generally portable or stationary beamed lights are possible. Numerous alterations of the structures herein disclosed will suggest themselves to those skilled in the art. However, it is to be understood that the present disclosure relates to a preferred embodiments of the invention which is for the purposes of illustration only and not to be construed as a limitation of the invention.

I claim:

1. A light beam concentrating, intensifying and filtering device for use in combination with a parallel ray light beam source comprising:

a frame with a aperture therein;

a plurality of curved shutter leaves disposed around the circumference of said frame, each said leaf being pivotally connected at one end to said frame and pivotally and slidably connected at the other end to a rotatable ring mounted on said frame coaxial with the center of said aperture; said ring, when rotated, causing said leaves to open or close said aperture;

wherein each of said leaves is comprised in part of transparent material and in part of opaque material, such that when said aperture is substantially closed by said leaves, the transparent portions of the said leaves are disposed in the central portion of said aperture and the opaque portions of said leaves are disposed in the remaining portion of said aperture.

2. The device of claim 1 wherein said parallel ray light beam source is constituted by a light source backed by a parabolic reflector.

3. The device of claim 1 wherein said shutter leaves are geometrically disposed in a curvilinear plane and wherein said opaque material is reflecting material, such that light rays reflected from the reflecting portions of said shutter leaves are directed back onto said parabolic reflector and ultimately emerge through the transparent portion of said shutter leaves.

4. The device of claim 1 wherein said shutter leaves are geometrically disposed in a flat plate and wherein said opaque material is reflecting material, such that light rays reflected from the reflecting portions of said shutter leaves are directed back onto said parabolic reflector and ultimately emerge through the transparent portion of said shutter leaves.

5. The device of claim 3 wherein said reflecting portions of said shutter leaves reflect only light of a relatively narrow portion of the visible light spectrum.

6. The device of claim 3 wherein each of said shutter leaves is comprised of only opaque reflective material.

7. The device of claim 3 wherein each of said shutter leaves is comprised of only transparent material.

8. The device of claim 4 wherein said reflecting portions of said shutter leaves reflect only light of a relatively narrow portion of the visible light spectrum.

9. The device of claim 4 wherein each of said shutter leaves is comprised of only opaque reflection material.

10. The device of claim 4, wherein each of said shutter leaves is comprised on only transparent material.

11. The device of claim 5 wherein each of said shutter leaves is comprised only of opaque reflective material.

12. The device of claim 8 wherein each of said shutter leaves is comprised only of opaque reflective material.

13. The device of claim 7 or claim 10 wherein said transparent material is tinted so as to allow passage of only a relatively narrow portion of the visible light spectrum.

14. The device of claim 3 or claim 4 wherein at least a part of said reflecting portions of said shutter leaves reflect only light of a relatively narrow portion of the visible light spectrum.

* * * * *

UNITED STATES PATENT AND TRADEMARK OFFICE

CERTIFICATE OF CORRECTION

PATENT NO. : 4,458,303

DATED : July 3, 1984

INVENTOR(S) : Michael S. Berns

It is certified that error appears in the above-identified patent and that said Letters Patent is hereby corrected as shown below:

On the cover page, left hand side of the heading, please delete "18 E. Old Willow Road, Suite 220N, Prospect Heights, Ill. 60070" and insert --1311 Kilborn Ave., Ottawa, Ontario, K1H 6L2, Canada--

Column 4, please delete the last two paragraphs in this column from line 52 to the end of the column.

Column 5, line 35, after "frame with" please change "a" to --an--.

Column 6, line 15, please change "plate" to --plane--.

Column 6, line 34, please change "on" to --of--.

Signed and Sealed this

*Fifth* Day of *March 1985*

[SEAL]

*Attest:*

DONALD J. QUIGG

*Attesting Officer* *Acting Commissioner of Patents and Trademarks*